US012352533B1

(12) United States Patent
Schoening

(10) Patent No.: US 12,352,533 B1
(45) Date of Patent: Jul. 8, 2025

(54) NEXT SHOT COMPENSATION SYSTEM FOR WEAPONS

(71) Applicant: OPTEX SYSTEMS, INC., Richardson, TX (US)

(72) Inventor: Danny Schoening, Richardson, TX (US)

(73) Assignee: Optex Systems, Inc., Richardson, TX (US)

( * ) Notice: Subject to any disclaimer, the term of this patent is extended or adjusted under 35 U.S.C. 154(b) by 0 days.

(21) Appl. No.: 18/651,580

(22) Filed: Apr. 30, 2024

(51) Int. Cl.
*F41G 3/12* (2006.01)
*F41G 3/08* (2006.01)
*F41G 3/14* (2006.01)

(52) U.S. Cl.
CPC ..... *F41G 3/12* (2013.01); *F41G 3/08* (2013.01); *F41G 3/142* (2013.01)

(58) Field of Classification Search
CPC ..... F41G 3/00; F41G 3/08; F41G 3/12; F41G 3/142
See application file for complete search history.

(56) References Cited

U.S. PATENT DOCUMENTS 4,457,206 A * 7/1984 Toulios ..... F41G 5/08 89/14.05
5,988,645 A 11/1999 Downing
9,817,015 B2 11/2017 Oehler et al.
10,006,981 B2 6/2018 Tidhar
11,320,447 B2 5/2022 Itz et al.
11,874,093 B2 1/2024 Clermont et al.
2009/0320348 A1 12/2009 Kelly
2016/0238338 A1 8/2016 Itz et al.
2017/0350914 A1 12/2017 Oehler
2017/0357002 A1* 12/2017 Winker ..... G01S 17/10
2019/0056198 A1 2/2019 Pautler
2019/0376764 A1* 12/2019 Hammond ..... F41G 1/38
2020/0232737 A1 7/2020 McClellan et al.
2020/0300579 A1 9/2020 Baumgartner
2021/0341746 A1 11/2021 Aizpuru et al.
2022/0178657 A1 6/2022 Gallery et al.
2023/0046334 A1 2/2023 Arbouw et al.
2023/0058539 A1 2/2023 Ortega
(Continued)

OTHER PUBLICATIONS

Frode Tennebo, "Improving Classification of Ballistic, Non-Cooperative Radar Targets", Jan. 31, 2022, Ostfold University College, Halden, Norway www.hiof.no, 96 pages.

*Primary Examiner* — Laura A Gudorf
(74) *Attorney, Agent, or Firm* — J. Miguel Hernandez; David W. Carstens; Carstens, Allen & Gourley, LLP

(57) ABSTRACT

Use of a muzzle velocity detector with a display allows for a rapid calculation of a second shot firing solution based on a first shot analysis. A doppler radar emitter and detector is located in a housing. The housing has a mount that allows it to be coupled to a hand guard on a rifle. This allows for the muzzle velocity to be detected very close to the end of the barrel. Information about the bullet can be preloaded into a ballistics calculator. The ballistics calculator can be integrated with the muzzle velocity detector or coupled wirelessly to it. The impact location of the first shot is identified and that "drift" is used with muzzle velocity and many other factors to quickly provide a compensation to be used with the sight to ensure the second shot is more accurate.

20 Claims, 10 Drawing Sheets

(56) References Cited

U.S. PATENT DOCUMENTS

| | | | | |
|---|---|---|---|---|
| 2023/0113472 | A1 | 4/2023 | Gallery et al. | |
| 2023/0168362 | A1 * | 6/2023 | Martin | G01S 13/345 342/109 |

* cited by examiner

NEXT SHOT COMPENSATION SYSTEM FOR WEAPONS

TECHNICAL FIELD OF THE INVENTION

The invention relates to a method of improving the accuracy of a second shot by rapidly analyzing the trajectory and accuracy of a first shot taken by a weapon such as a long-range rifle. Accuracy is improved by determining the muzzle velocity of a bullet shortly after it leaves the barrel of the rifle and using that information with other sensed data and historical data to recalculate and readjust a new firing solution.

BACKGROUND OF THE INVENTION

The effectiveness of rifles for sport or in warfare is improved with greater accuracy. But accuracy, or the ability to hit a target, is impacted by many factors. For example, the muzzle velocity is particularly important to the accuracy of a shot. A bullet travels in a substantially parabolic path. Gravity is pulling the bullet downwards, while the explosive force of the propellant creates acceleration on the bullet in the horizontal. Once the bullet exits a rifle's barrel, it has achieved a muzzle velocity and the accelerative force of the propellant, usually gun powder, dissipates and the bullet achieves its muzzle velocity.

For a sniper rifle, the muzzle velocity is typically around 2800 to 3000 feet per second. In other words, if the target is 3000 yards down range, the bullet will take more than 3 seconds to reach the target. Air resistance slows the bullet velocity from its initial muzzle velocity down to a terminal velocity. Terminal velocity is the velocity of the bullet when it hits the target. For example, a .30 caliber bullet with a muzzle velocity of 2500 to 3000 feet per second might have a terminal velocity of only 300 feet per second down range.

Calculation of terminal velocity depends on many variables, such as the distance to the target, conditions of the air between the shooter and the target, the coefficient of drag on the bullet, as well as the initial muzzle velocity. These factors have been recognized by snipers as well as everyday shooters for years and attempts have been made to improve the performance of each shot by taking these factors into consideration. The problem that arises is that the first shot taken is usually "cold" meaning that the barrel is at ambient temperature and that environmental conditions are not well known for the entire flight path of the bullet, nor is the muzzle velocity. But the behavior and accuracy of that first shot can be used to improve the second shot.

In warfare, it is advantageous for a sniper to be able to take an improved second shot quickly. If a first shot misses a target, the sound from the missed shot will reach the target and alert him to move or to take better cover. For a target at a distance of one mile (around 1600 meters), the sound of the shot takes around 5 seconds to reach the target because sound travels at around 340 meters/second. The bullet, of course, reaches the target distance before the sound of the first shot reaches the target. So, the ability to adjust aim quickly based on the performance of the first shot is paramount to having a successful second shot.

A sniper, or a competitive shooter, takes aim at his target using a scope that provides a better view of the target. A scope can be adjusted based on the impact location of a first shot. In other words, if the scope is sighted to the center of a concentric target and the bullet impacts 12 inches to the right of the target center, the scope has adjustment dials that take that deviation into account. But even with that adjustment, there are so many factors that affect the bullets' trajectory, that ballistic computers can be employed to assist with the calculations. For example, the Garmin Xero CI Pro Chronograph, shown in FIG. 1, is a standalone unit 100 that is placed near the shooter. It can measure the bullet velocity at 20-30 feet from the muzzle and then calculate the estimated muzzle velocity. The unit 100 includes a stand 104 for keeping it stable. A display 106 is located in the unit's housing 102. The display 106 can provide a current shot muzzle velocity, in this instance 2877.2 feet per second, as well as previous shot muzzle velocities. Muzzle velocity can vary from shot to shot due to many variables, one of which might be minor differences in the powder load of the cartridge. One disadvantage of the stand alone unit is that it must be moved and repositioned with the shooter if the shooter must move.

Other essential data includes the type and amount of gun powder used, the weight of the bullet, the ballistic coefficient, and even whether the load was from the factory or hand loaded. Digesting this volume of data and providing meaningful output for the shooter can be assisted with a ballistics solver, essentially a dedicated and portable computer or phone-based application that provides a firing solution. An example of a handheld ballistics calculator is the Kestrel brand model 5700X shown in FIG. 2. The ballistics calculator 200 can take into account wind speed and humidity conditions as well as calling upon a data library of most known factory bullets. Wind speed can be captured by turbine 202. Humidity can be detected with sensor 204. A display 206 provides this data to the shooter. Controls 208 allow the user to scroll through various screens of information.

Another example is shown in U.S. Pat. No. 11,874,093 to Sheltered Wing that provides a ballistic solution calculator for long range shots. The ballistic solution is communicated to a viewing optic or a rangefinder. The bullet profile is preloaded (including its expected velocity) into the calculator. Oher factors such as weather conditions can be sensed in real-time.

Others have developed devices to help with portions of the problem of quickly adjusting for a second shot. For example, U.S. Pat. No. 11,320,447 to Itz provides a device that mounts to the rifle but has an assembly that extends beyond the barrel and under the initial flight path of the bullet. Velocity measurements are shown on an attached display. Likewise, US Publication 2017/0350914 measures initial velocity and time of flight of a bullet. The velocity measuring instrument is located near the rifle. However, the main focus appears to be calculating a more accurate coefficient of drag for the bullet.

Another variable for a shooter is the "seasoning" of his barrel. Bullet velocities increase as a barrel is seasoned. The general belief is that molecular copper is driven into the pores of the steel barrel and become permanently embedded which creates a smoother bore. This eventually levels out after 50-100 shots. But shooters/snipers have to change barrels eventually. Knowing the current barrel's performance is not addressed in the prior art.

Further, as the shooter shoots multiple shots, the barrel heats up and therefore the velocities can increase. The explosive power of the gun powder increases as the ambient temperature increase, so cartridges left in a hot barrel will absorb the heat and therefore velocities will increase. A need exists for a device that knows the number of shots taken and that can measure or calculate the temperature of the barrel and its impact on trajectory.

A need exists for a method of measuring a muzzle velocity accurately and near the end of the barrel. Measurements taken even feet from the barrel end have already lost a meaningful amount of velocity and thus introduce error into the calculation. Measurements taken at the very end of a barrel can be confused by smoke and other visual hindrances to accurate measurements. Once the accurate muzzle velocity is measured, it must be used in a ballistic calculator and a new firing solution must be displayed near the shooter (or his spotter) to allow for a rapid adjustment.

A need further exists for a single, mountable unit that incorporates the ballistic calculator, the muzzle velocity measurement, and other sensors. This integrated device would be mounted on the rifle and within easy view of the shooter. It would provide almost instant feedback on the first shot and then provide a new firing solution. This integrated solution will also have the ability to communicate with external devices wirelessly.

SUMMARY OF THE INVENTION

The present invention is an integrated and mountable muzzle velocity detector and ballistics calculator system with access to historical data. It can be mounted on the rifle and provide an easy display of first shot results to the shooter.

By collecting real time data with the prior shot's performance, a new solution can be quickly determined and proposed to the shooter for the "Next Shot" thereby further improving the statistical probability of a successful hit on the next shot. The method includes the following steps:

1. Once the shooter has reduced the internal variables to minimize the variation in velocity, they input the Mean Muzzle Velocity into the Ballistic Solver.
2. They then input the other internal variables needed to determine the flight profile (bullet weight, barrel twist, etc.).
3. Finally they input the external variables (temperature, humidity, elevation, direction of fire, etc.) and execute the calculation.
4. The Ballistic Solver will then provide an Elevation and Azimuth Solution.
5. The shooter adjusts the scope per the Ballistic Solver's recommendations and shoots at the target.
6. The shooter (or a partner spotter) records the impact position (tap a location on an APP or computer screen or manually) and then deploys the "Next Shot" calculator to recalculate the next recommended solution. The "Next Shot" calculator can be one device (like an App on a cell phone with calculating and display ability) or it can be divided between devices (like the Ballistic Calculator is in the same device as the Doppler Radar sensor and the App is displaying the results) or the display can be on the cell phone app, or on another mobile device.

The next shot solution can combine the historical data of the cartridge and gun system, with the current external environmental conditions, with the actual performance of the last shot including its actual muzzle velocity recorded and impact location. By statistically analyzing this data, the "Next Shot" program can provide a new solution which has a higher statistical probability of impact on the next shot. Further, this data can be collected over time and fed into an Artificial Intelligence (AI) program which could further improve the probabilities and allow an increased amount of input variables (gun movement at firing for potential trigger "jerks" measured by accelerometers, wind gusts, target distances, etc.).

Finally, "Next Shot" could also collaborate with other users' data from similar apps and combine not only their performance data, but also that of similar bullet and gun systems to expand the data base to countless other users therefore expanding the statistical database the system references.

Two more examples of variables can be addressed by the current invention: barrel seasoning and barrel temperature. Bullet velocities increase as a barrel is "seasoned". The current invention can track or allow the input of a barrel identifier. The current invention also tracks the number of shots taken and the time between shots, therefore it can calculate the barrel temperature and thus compensate for the barrel temperature on muzzle velocity. As before, the number of variables affecting a bullet's trajectory can be overwhelming for a shooter to track and compensate for quickly.

As the database of shot data grows, an AI portion of "Next Shot" could also use data from other shooters using similar calibers on similar latitudes and longitudes to help calibrate and predict the Coriolis effect and various spin drifts of different turn (twist rates) barrels.

Accordingly, what is needed in the art is a device and related method for allowing an accurate measurement of a first shot muzzle velocity coupled with a ballistics computer to provide the shooter with rapid adjustment for a second shot.

BRIEF DESCRIPTION OF THE DRAWINGS

The novel features believed characteristic of the disclosure are set forth in the appended claims. The disclosure itself, however, as well as a preferred mode of use, further objectives, and advantages thereof, will be best understood by reference to the following detailed description of illustrative embodiments when read in conjunction with the accompanying drawing, in which:

DETAILED DESCRIPTION OF THE INVENTION

Figure 1:
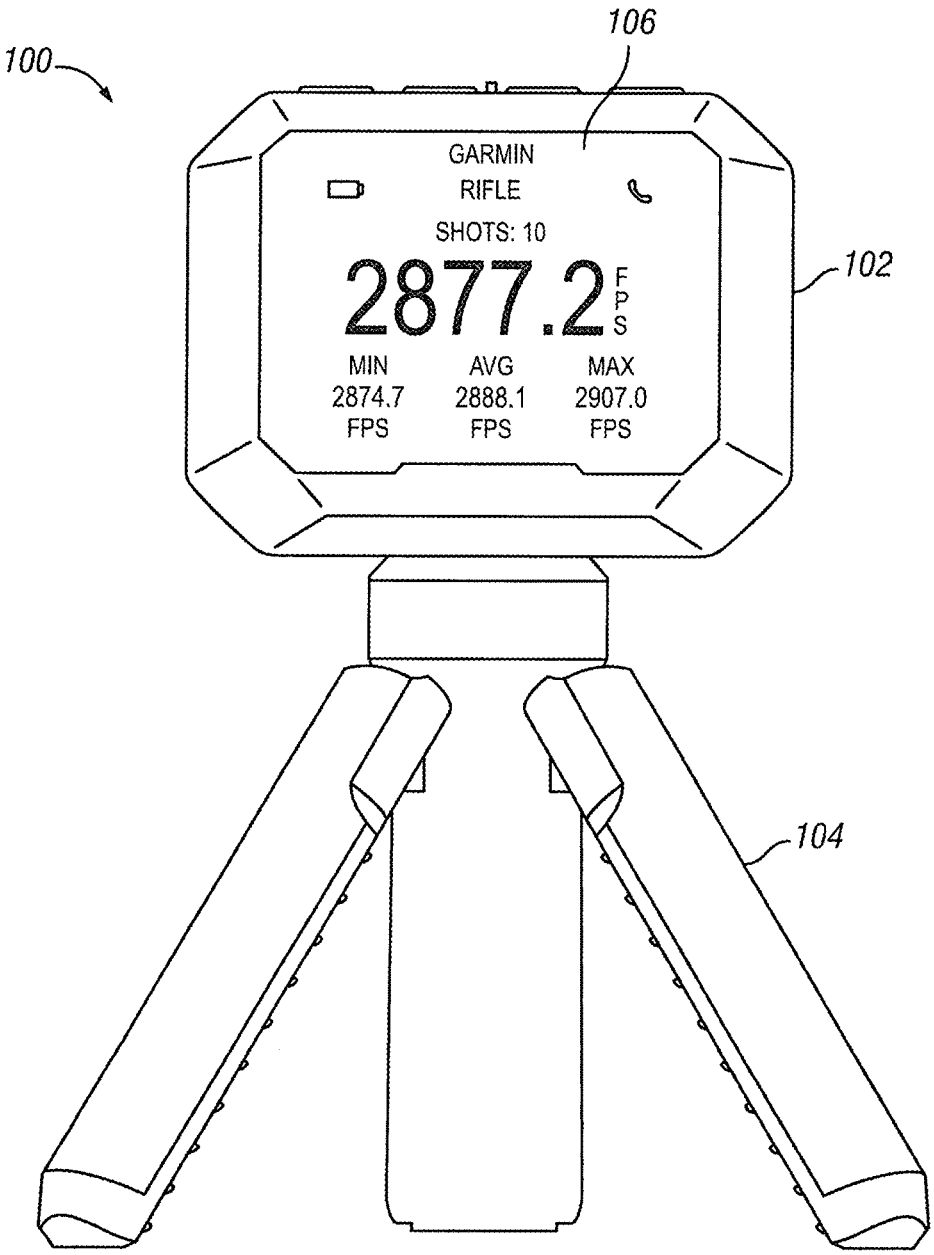
FIG. 1 (Prior Art)
FIG. 1 is a prior art velocity detector with a display.
Figure 2:
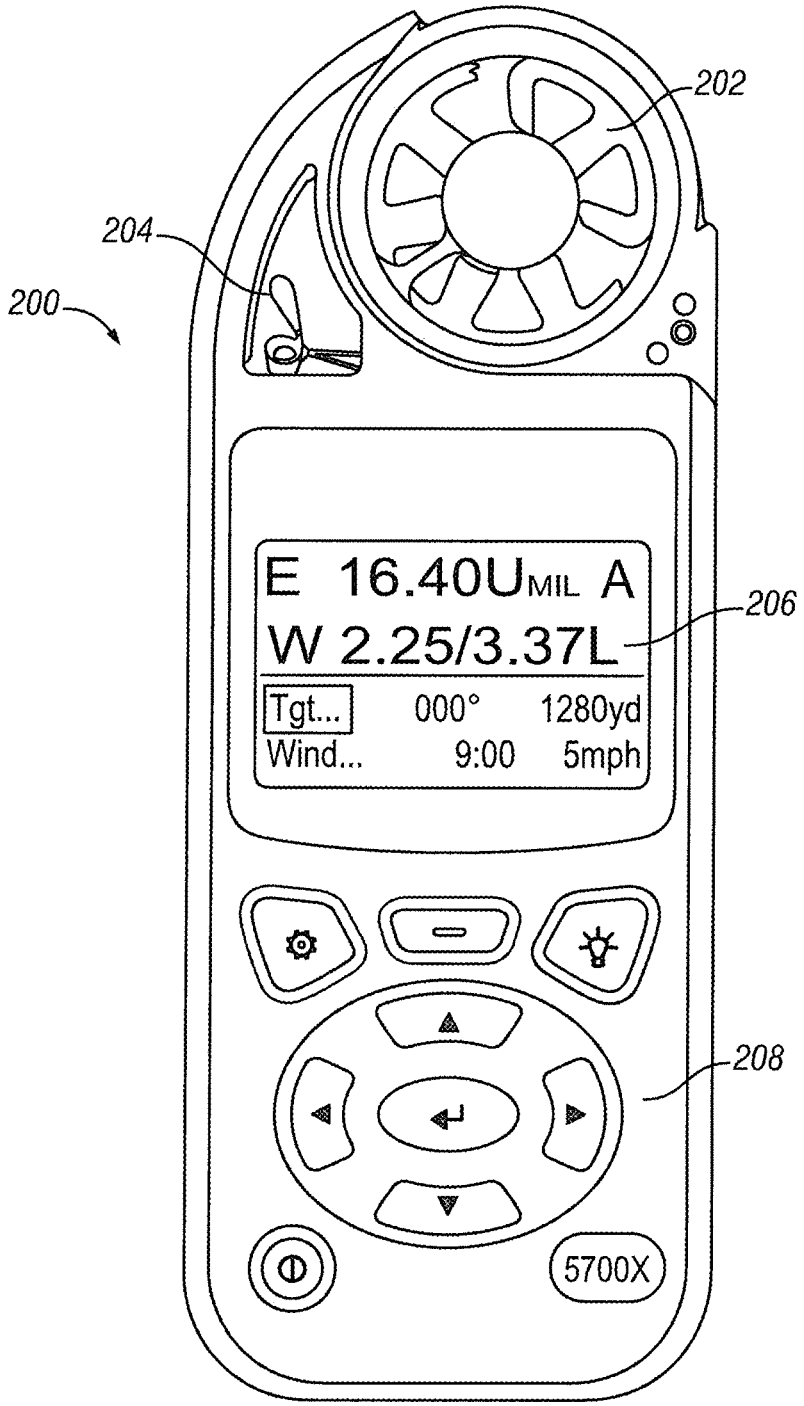
FIG. 2 (Prior Art)
FIG. 2 is prior art ballistic calculator.
Figure 3:
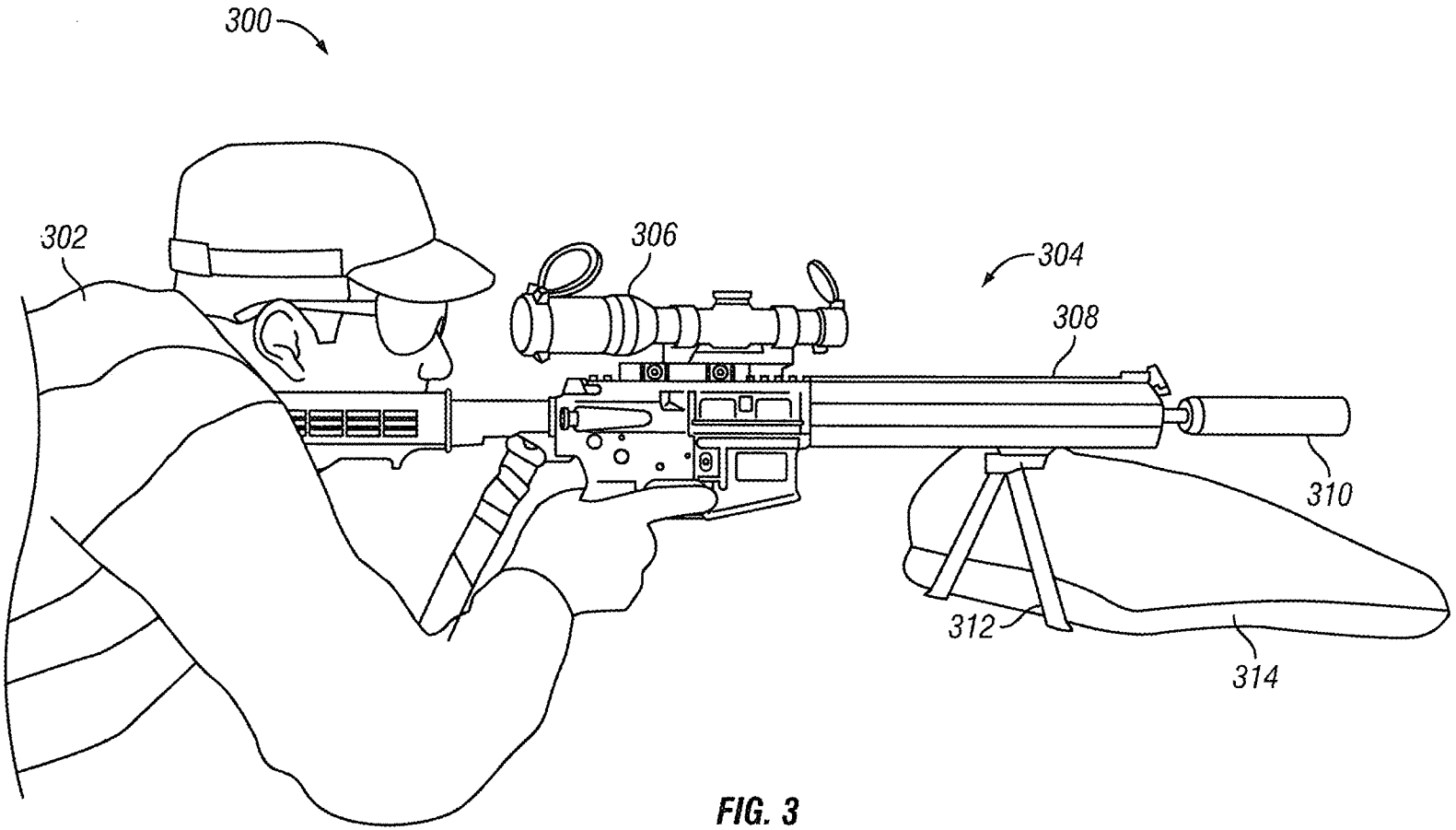
FIG. 3 shows a shooter in a prone position.

A shooter attempting an accurate long-range shot must take a posture 300 that provides stability for the shooter 302 and his rifle 304. It is common to lay prone to the ground as shown in FIG. 3. The shooter 302 is lying prone on the ground with his rifle 304 propped on a stand 312. The rifle 304 has a scope 306 and a hand guard 308. Hand guards provide a series of mounting surfaces that will conveniently accept various accessories. In this instance the rifle 304 has a barrel with a suppressor 310 to minimize the noise emitted by a shot. Also, a weighted bag 314 is present to dampen any forward movement of the rifle during shooting.

Figure 4:
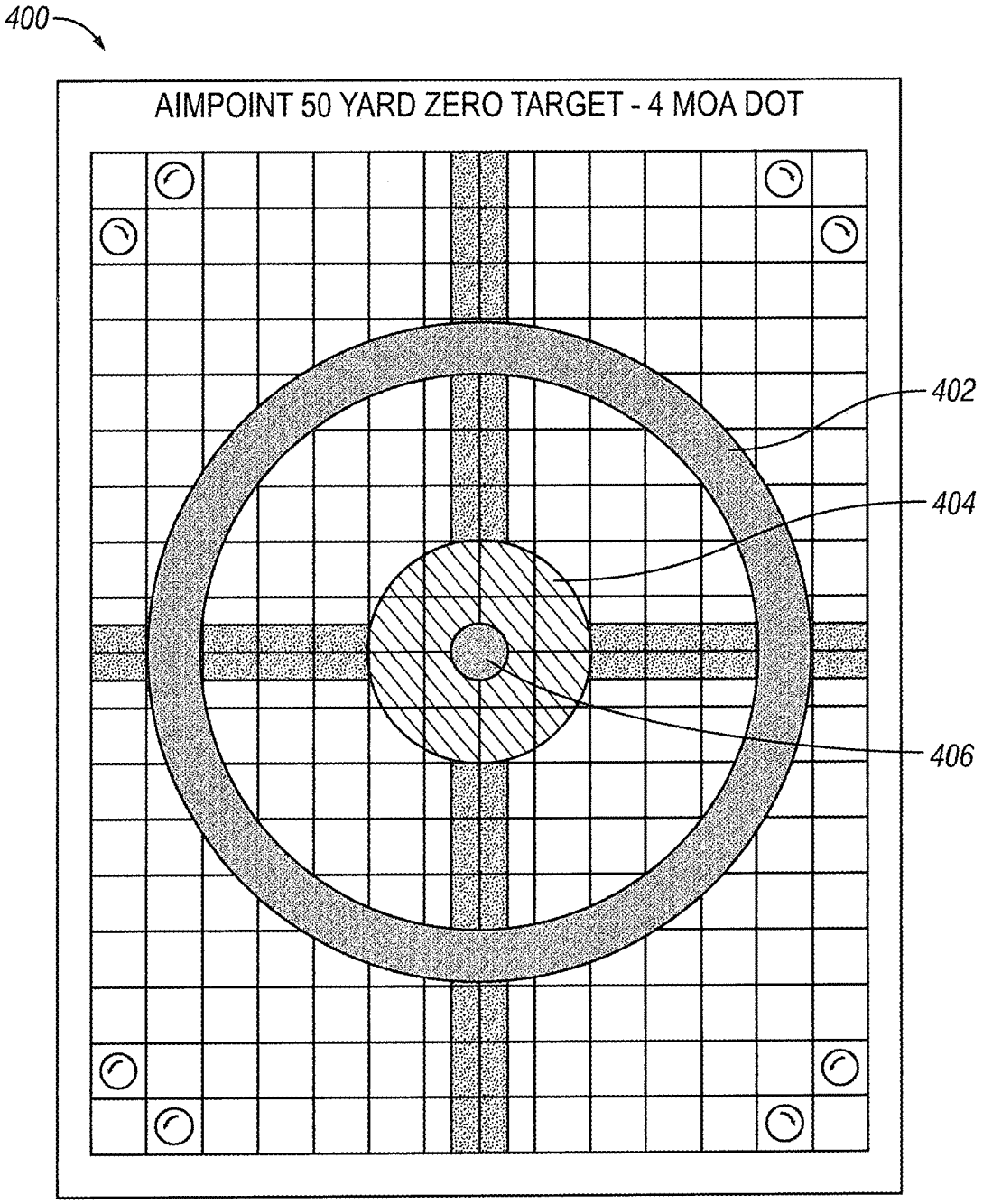
FIGS. 4 and 4*a* show a standard target to illustrate the need for adjustment.

The shooter may be taking aim at a standard target 400, such as the one shown in FIG. 4. It includes a series of concentric rings 402, 404 and 406. An inner ring, or zero point or bullseye 406 is the optimal location on the target. Using his scope, the shooter will zero in on the bullseye 406 and take a shot.

Figure 4A:
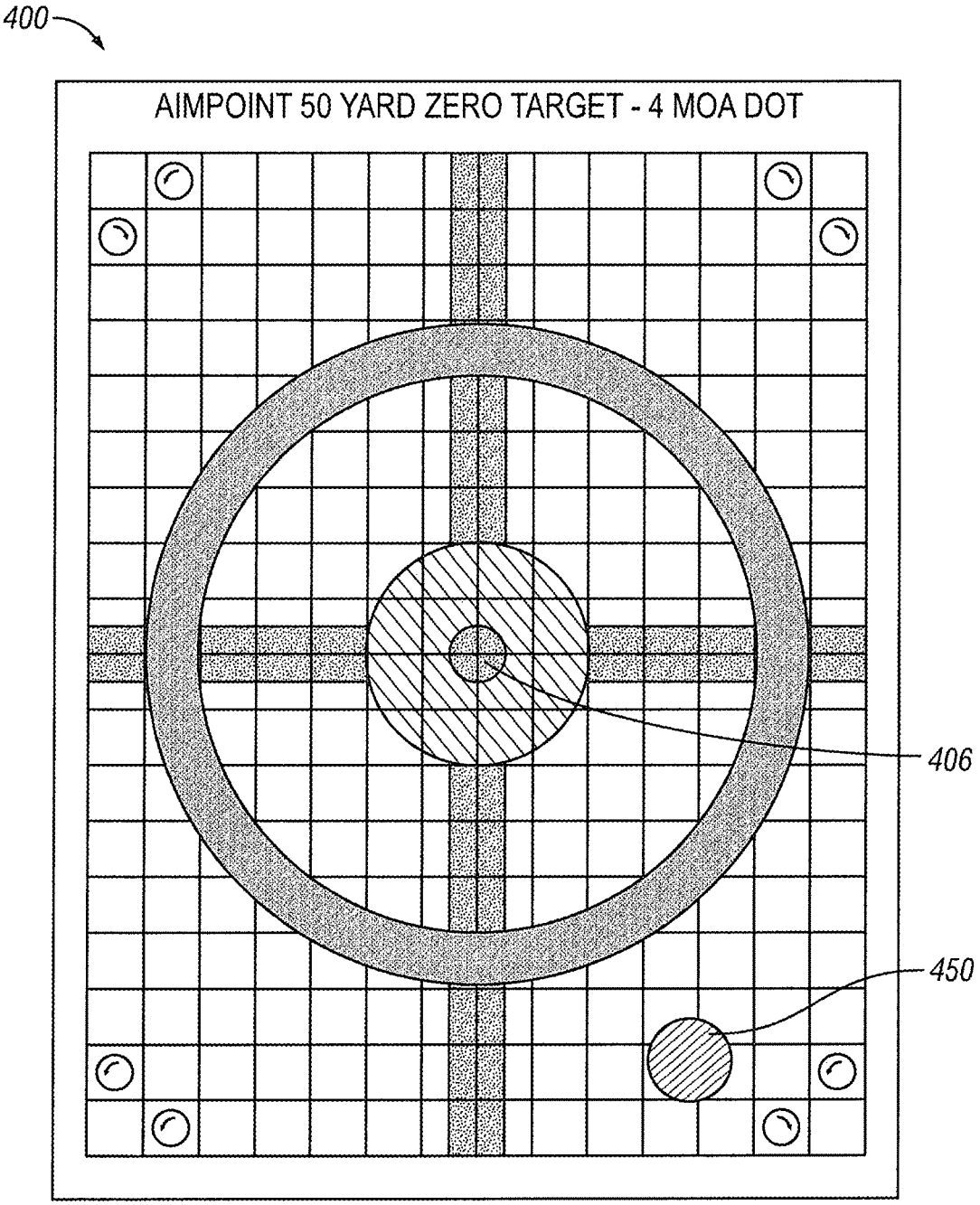

Based on the many factors discussed above, that shot may miss as shown in FIG. 4*a*. This "first shot" 450 has impacted the target to the right and below the bullseye 406. A spotter or the shooter will enter this information into the ballistic calculator. A second firing solution is then calculated using the information gathered by the current invention. In one embodiment, a digital scope automatically identifies the impact location and measures the distance from the intended bullseye. That measurement is then manually or automatically transmitted to the ballistic calculator.

Figure 5:
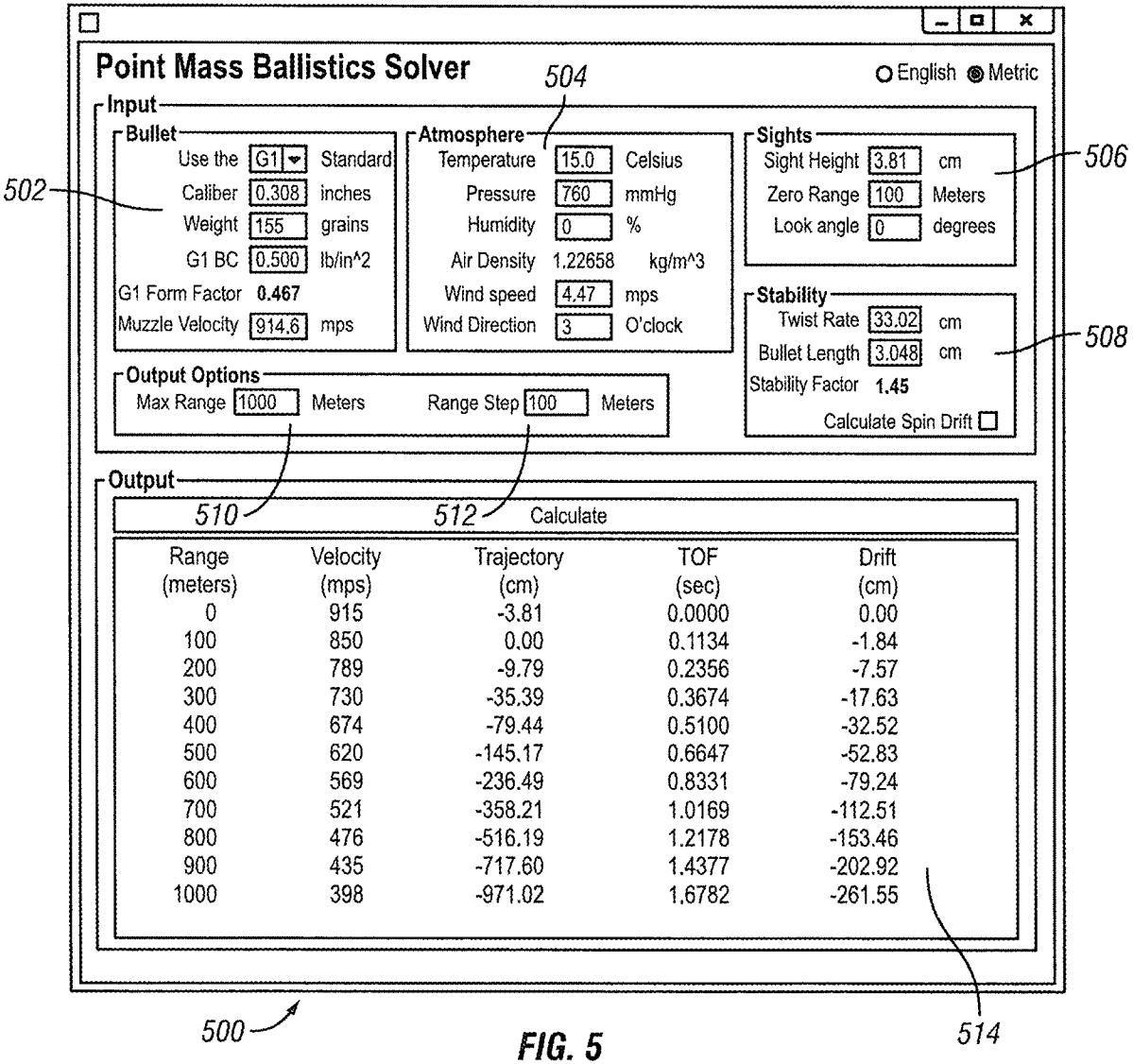
FIG. 5 provides a ballistics solver that can be utilized to show the impact of various factors on bullet accuracy.

FIG. 5 provides an illustration of data 500 that can be gathered and assimilated by the ballistics calculator. In one embodiment of the invention, the ballistics calculator is separate from the muzzle velocity detector. In another embodiment, it is integrated with the muzzle velocity detector. One category of data includes bullet specific data 502. This includes the caliber, weight and powder load. Another category is atmospheric data 504. This can include temperature and pressure readings as well as humidity, wind speed and wind direction readings. Information such as air density can be calculated from those measurements. Next, information 506 about the rifle sight can be used. This can include the height of the sight, its focus point or "zero range" and the look angle. Stability 508 data can also be used including twist rate and bullet length. This data can be used to calculate a stability factor used by the ballistics calculator. Output options such as max range 510 and range stop 512 can be set by the user. The shooter can then calculate the projected trajectory out to the set max range, in this instance 1000 meters. The bullet velocity is calculated and shown at various distances to target. For example, a muzzle velocity of 915 meters per second will decrease to 398 meters per second at the range of 1000 meters. More importantly, the amount of drift is shown at each incremented distance. In this example, the drift is shown as 261.55 centimeters at 1000 yards. This is driven by time to target, atmospheric conditions, stability and other factors used by the calculator. But to put this in meaningful terms, after the bullet has travelled 1000 yards, it has already drifted over two meters from the intended target. This is why compensation for the second shot is crucial.

Data can also include GPS location of the weapon. Further, the direction of fire is also relevant to the ballistic firing solution. The present invention can use all of this information to adjust for the amount of earth movement in the seconds it takes between the weapon being fired and the bullet striking the target.

Figure 6:
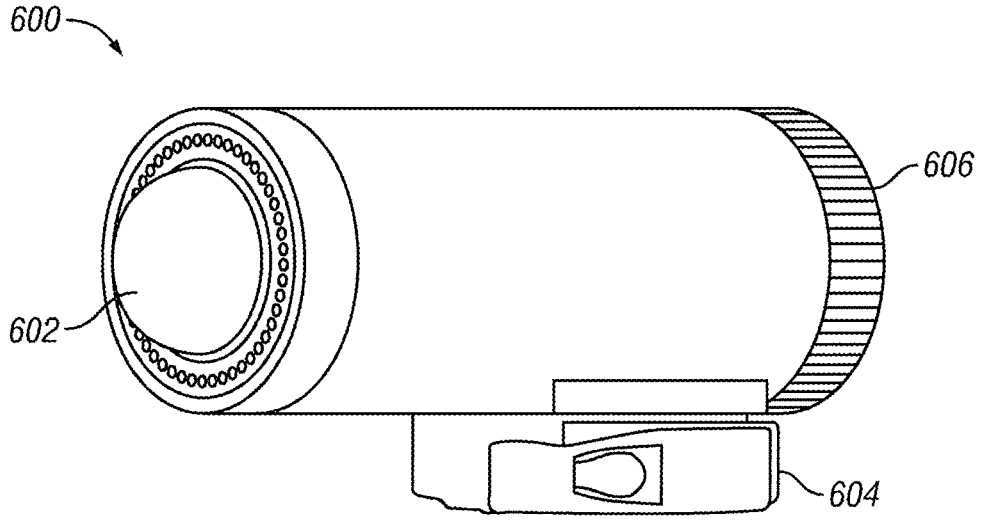
FIG. 6 is an example of a mountable velocity detector.

FIG. 6 illustrates an embodiment of the present invention. The muzzle velocity detector 600 is housed in a generally cylindrical housing having a sensor array 602 behind a front dome. A mounting coupler 604 can be used to attach the detector 600 to a rifle. The coupler 604 is common in the industry and allows for quick attachment to the hand guard used around the barrel of many rifles. Finally, a display 606 provides feedback to the shooter. A doppler radar unit located behind the dome can send out a radar signal that bounces off of the bullet. A doppler radar is a specialized radar that uses the Doppler effect to produce velocity data about objects at a distance. It does this by bouncing a microwave signal off a desired target and analyzing how the object's motion has altered the frequency of the returned signal. This variation gives direct and highly accurate measurements of the radial component of a target's velocity relative to the radar. The term applies to radar systems in many domains like aviation, police radar detectors, navigation and meteorology.

Figure 7:
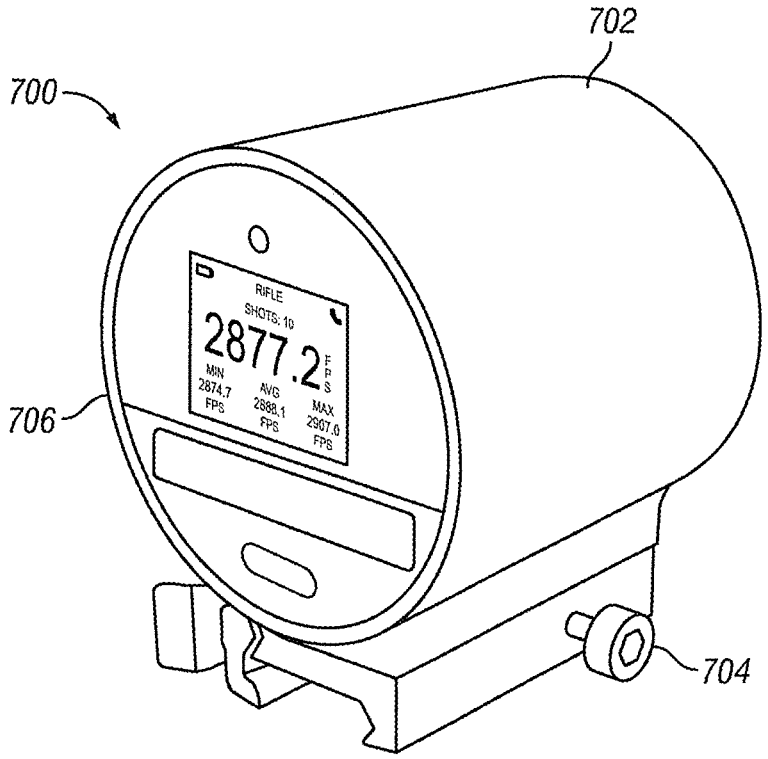
FIG. 7 illustrates a preferred embodiment of a muzzle velocity detector with integrated display.
Figure 7A:
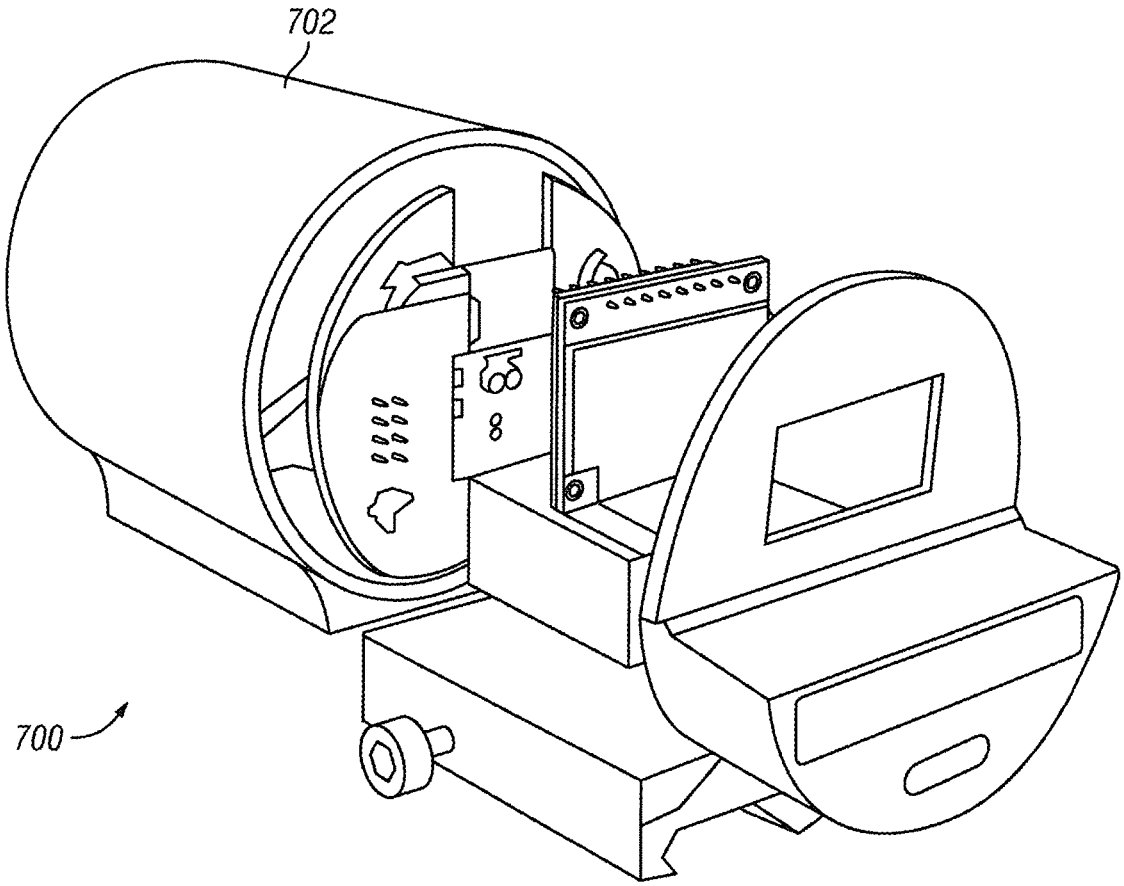
FIG. 7*a* is an exploded view showing a detector and display.

FIG. 7 shows a preferred embodiment of the invention 700. Again, the sensors and ballistics calculator can be housed in a generally cylindrical housing 702. A mount or coupler 704 can couple the detector 700 to a rifle (not shown). A display 706 provides almost instant feedback to the shooter regarding the detected muzzle velocity. The sensor and other internal components of the invention are shown in the exploded view of FIG. 7*a*. For example, a doppler radar such as the Silicon Radar Model TRX_120_001 could be used.

Figure 8:
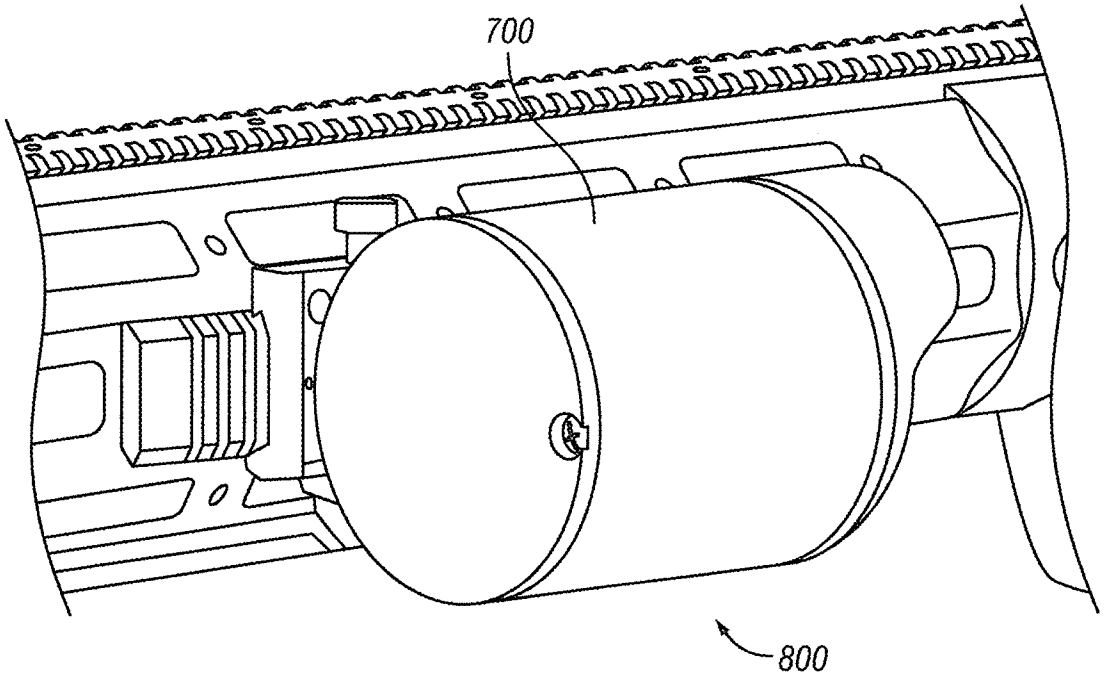
FIG. 8 shows the preferred embodiment mounted on a rifle.

FIG. 8 shows the preferred embodiment in the preferred environment 800, namely mounted to the hand guard on the side of the rifle. This keeps the detector 700 out of the scope sight line which is typically located on the top of the surface of the rifle.

Figure 9:
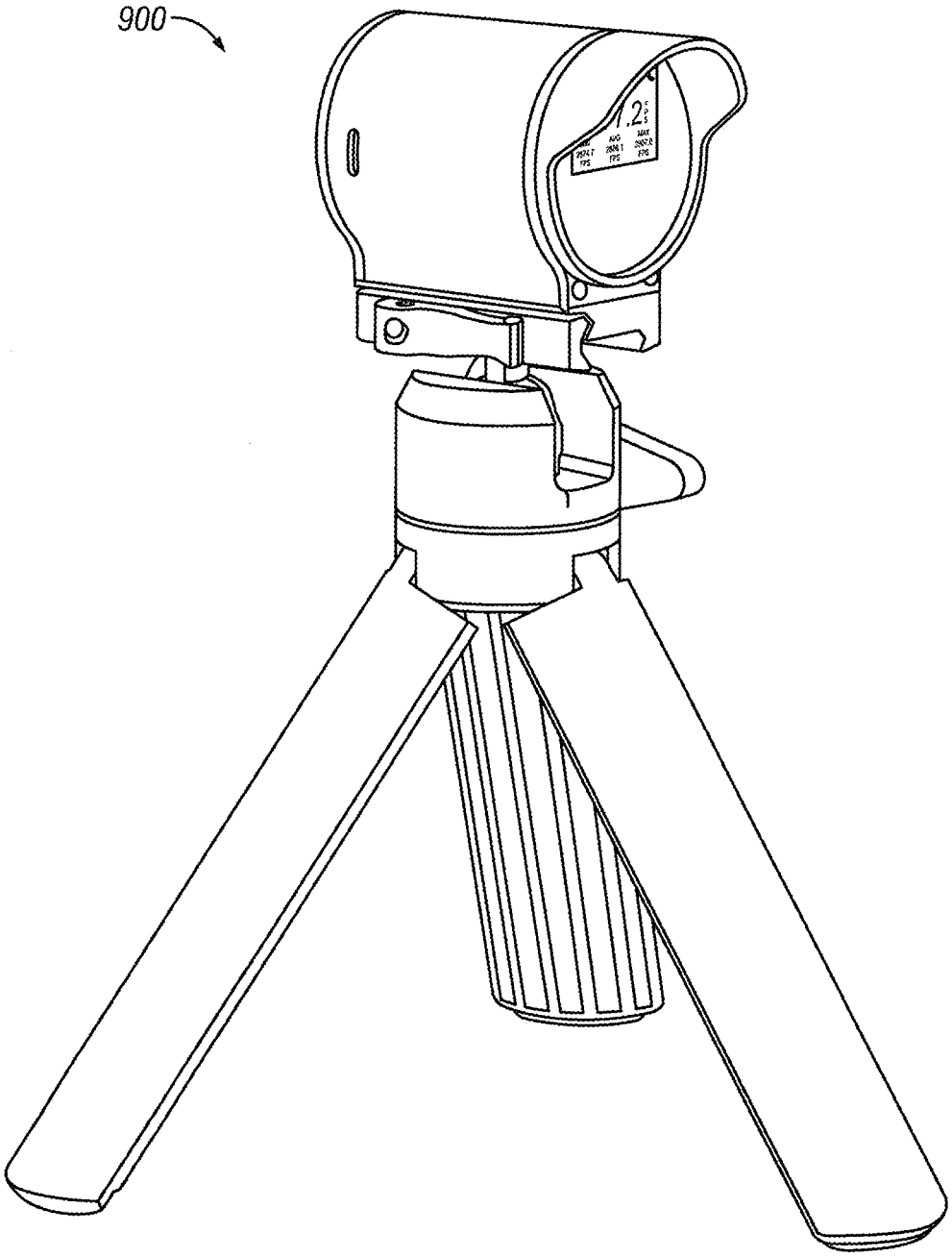
FIG. 9 shows the preferred embodiment mounted on a tripod.

Finally, FIG. 9 illustrates the invention located on a tripod 900. This adds to portability issues but also allows more flexibility in the placement of the detector.

While this disclosure has been particularly shown and described with reference to preferred embodiments, it will be understood by those skilled in the pertinent field art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this disclosure includes all modifications and equivalents of the subject matter recited in the claims appended hereto, as permitted by applicable law. Moreover, any combination of the above-described elements in all possible variations thereof is encompassed by the disclosure unless otherwise indicated herein or otherwise clearly contradicted by context.

Also, while various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Any and all publications, patents, and patent applications cited in this disclosure are herein incorporated by reference as if each were specifically and individually indicated to be incorporated by reference and set forth in its entirety herein.

What is claimed is:

1. A system for correcting a second shot trajectory based on a first shot analysis, the system comprising:

(a) a muzzle velocity device mounted to a weapon to measure the muzzle velocity of a bullet, and (b) a communication means for transmitting a measured muzzle velocity and at least one additional measurement from the first shot to a ballistic calculator, wherein the ballistic calculator recalculates a new ballistic solution, and wherein the at least one additional measurement comprises a Global Positioning System (GPS) location of the weapon.

2. The system of claim 1 wherein the at least one additional measurement further comprises an impact location, a wind velocity, a humidity measurement, a ballistic coefficient for the bullet, a compass direction of fire from the weapon, or any combination thereof.

3. The system of claim 1 further comprises:

(c) a display for showing the measured muzzle velocity, wherein the system displays a shot correction that corresponds to an adjustment to a zero point of the weapon scope.

4. The system of claim 1 wherein the ballistic calculator can use:

a shooter's historical data, machine learning from the shooter's historical data combined with other shooters' historical data to provide a new ballistic solution; or artificial intelligence from a shooter's historical data to provide the new ballistic solution.

5. The system of claim 1 wherein the muzzle velocity device comprises a doppler radar, and wherein the doppler radar operates at a frequency to detect a bullet near a distal end of a barrel on a weapon.

6. The system of claim 1 further comprises:

(c) a coupler for mounting the system to the weapon, a stand to allow the system to be located near a distal end of the weapon, or a combination thereof.

7. The system of claim 1 further comprises:

(c) a scope mounted to the weapon for spotting a downrange target, wherein the scope comprises a means to determine a distance between a first shot impact and a zero point of the downrange target.

8. A system for correcting a second shot trajectory based on a first shot analysis, the system comprising:

(a) a muzzle velocity device mounted to a weapon to measure the muzzle velocity of a bullet, (b) a communication means for transmitting a measured muzzle velocity and at least one additional measurement from the first shot to a ballistic calculator, wherein the ballistic calculator recalculates a new ballistic solution, and (c) a display for showing the measured muzzle velocity, wherein the system displays an average of recent muzzle velocity measurements.

9. The system of claim 8 wherein the at least one additional measurement comprises an impact location, a wind velocity, a humidity measurement, a Global Positioning System (GPS) location of the weapon, a ballistic coefficient for the bullet, a compass direction of fire from the weapon, or any combination thereof.

10. The system of claim 8 wherein the system further displays a shot correction that corresponds to an adjustment to a zero point of the weapon scope.

11. The system of claim 8 wherein the ballistic calculator can use:

a shooter's historical data, machine learning from shooter's historical data combined with other shooters' historical data to provide a new ballistic solution; or artificial intelligence from a shooter's historical data to provide the new ballistic solution.

12. The system of claim 8 wherein the muzzle velocity device comprises a doppler radar, and wherein the doppler radar operates at a frequency to detect a bullet near a distal end of a barrel on a weapon.

13. The system of claim 8 further comprises:

(c) a coupler for mounting the system to the weapon, a stand to allow the system to be located near a distal end of the weapon, or a combination thereof.

14. The system of claim 1 further comprises:

(c) a scope mounted to the weapon for spotting a downrange target, wherein the scope comprises a means to determine a distance between a first shot impact and a zero point of the downrange target.

15. A system for correcting a second shot trajectory based on a first shot analysis, the system comprising:

(a) a muzzle velocity device mounted to a weapon to measure the muzzle velocity of a bullet, and (b) a communication means for transmitting a measured muzzle velocity and at least one additional measurement from the first shot to a ballistic calculator, wherein the ballistic calculator recalculates a new ballistic solution, and wherein the new ballistic solution is further based on historical data from a shooter.

16. The system of claim 15 wherein the at least one additional measurement comprises an impact location, a wind velocity, a humidity measurement, a Global Positioning System (GPS) location of the weapon, a ballistic coefficient for the bullet, a compass direction of fire from the weapon, or any combination thereof.

17. The system of claim 15 further comprises:

(c) a display for showing the measured muzzle velocity, wherein the system displays an average of recent muzzle velocity measurements, a shot correction that corresponds to an adjustment to a zero point of the weapon scope, or a combination thereof.

18. The system of claim 15 wherein the ballistic calculator can use:

a shooter's historical data, machine learning from shooter's historical data combined with other shooters' historical data to provide a new ballistic solution; or artificial intelligence from a shooter's historical data to provide the new ballistic solution.

19. The system of claim 15 wherein the muzzle velocity device comprises a doppler radar, and wherein the doppler radar operates at a frequency to detect a bullet near a distal end of a barrel on a weapon.

20. The system of claim 15 further comprises:

(c) a coupler for mounting the system to the weapon, a stand to allow the system to be located near a distal end of the weapon, or a combination thereof.

* * * * *